US006094123A

United States Patent [19]

Roy

[11] Patent Number: 6,094,123

[45] **Date of Patent: *Jul. 25, 2000**

[54] LOW PROFILE SURFACE MOUNT CHIP INDUCTOR

[75] Inventor: Apurba Roy, Rockwall, Tex.

[73] Assignee: Lucent Technologies Inc., Muray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/160,978

[22] Filed: Sep. 25, 1998

[51] Int. Cl.[7] ..... H01F 5/00

[52] U.S. Cl. ..... 336/200; 336/96; 336/185; 336/192; 336/223; 336/232

[58] Field of Search ..... 336/200, 223, 336/96, 185, 192, 107, 232

[56] References Cited

U.S. PATENT DOCUMENTS

| | | | |
|---|---|---|---|
| 4,447,795 | 5/1984 | Sefko et al. | 336/178 |
| 4,597,169 | 7/1986 | Chamberlin | 29/605 |
| 5,206,620 | 4/1993 | Watanabe et al. | 336/84 M |
| 5,405,466 | 4/1995 | Naito et al. | 156/89 |
| 5,574,420 | 11/1996 | Roy et al. | 336/200 |
| 5,764,126 | 6/1998 | Kanetaka et al. | 336/96 |
| 5,802,702 | 9/1998 | Fleming et al. . | |

FOREIGN PATENT DOCUMENTS

| | | |
|---|---|---|
| 1439264 | 10/1968 | Germany . |
| 54-140164 | 10/1979 | Japan . |
| 57-48216 | 3/1982 | Japan . |
| 4-101404 | 4/1992 | Japan . |

*Primary Examiner*—Lincoln Donovan
*Assistant Examiner*—Tuyen T. Nguyen
*Attorney, Agent, or Firm*—Mathews, Collins, Shepherd & Gould, P.A.

[57] ABSTRACT

An integral low profile inductive device includes a magnetic body having opposing face surfaces, opposing side surfaces extending between the face surfaces, and opposing end surfaces extending between the side surfaces. A recessed surface is defined in each of the side surfaces of the body. A continuous winding of conductive material extends across the recessed surfaces and face surfaces of the body. Each of the recessed surfaces can be crenelated with alternating secondary recesses and projections such that the winding passes over the secondary recesses as it extends across the side surfaces of the body or over the projections between the secondary recesses. The device can include one or more continuous windings each of at least one turn.

8 Claims, 10 Drawing Sheets

LOW PROFILE SURFACE MOUNT CHIP INDUCTOR

FIELD OF THE INVENTION

This invention relates to inductors and in particular, to a low profile chip inductor for surface-mounting on a printed circuit board or metallized substrate.

BACKGROUND OF THE INVENTION

Inductors perform a wide variety of essential functions in many electronic devices. For example, inductors are used in power supplies as choke coils, for energy storage and to minimize noise and AC ripple. Inductors are also used in transformers to change voltage level and to provide isolation.

Inductors often comprise a magnetic core composed of an iron or ferrite material that is wound with a conductive coil. Consequently, inductors are often referred to as wire-wound coil devices.

One major difficulty with wire-wound coil devices is that they have relatively high-profiles which restrict miniaturization. While resistors, diodes, capacitors, and transistors have shrunk to the microscopic level, wire-wound coil devices remain bulky.

The size of conventional inductors is a particular problem in power circuits such as AC-DC and DC-DC power converters. Power converters remain bulky due, in large part, to the high profiles, large footprints, and high thermal resistances of the inductors and transformers. Furthermore, conventional inductors have a limited ability to transfer heat from the core and conductive windings to the device case or heat sink which necessitates larger surface areas for the entire circuit.

Accordingly, there is need for an improved low profile inductor which enables the miniaturization of power converters and other electronic devices.

SUMMARY OF THE INVENTION

An integral low profile inductive device comprises a magnetic body having opposing face surfaces, opposing side surfaces extending between the face surfaces, and opposing end surfaces extending between the side surfaces. A recessed surface is defined in each of the side surfaces of the body. An integral continuous winding of conductive material extends across the recessed surfaces and face surfaces of the body. Each of the recessed surfaces can be crenelated with alternating secondary recesses and projections such that the winding passes over the secondary recesses between the projections as it extends across the side surfaces or over the projections between the secondary recesses. The device can comprise one or more continuous windings each of at least one turn.

BRIEF DESCRIPTION OF THE DRAWINGS

The advantages, nature and various additional features of the invention will appear more fully upon consideration of the illustrative embodiments now to be described in detail in connection with the accompanying drawings wherein.

It is to be understood that these drawings are for purposes of illustrating the concepts of the invention and, except for graphical illustrations, are not to scale.

DETAILED DESCRIPTION OF THE INVENTION

Figure 1:
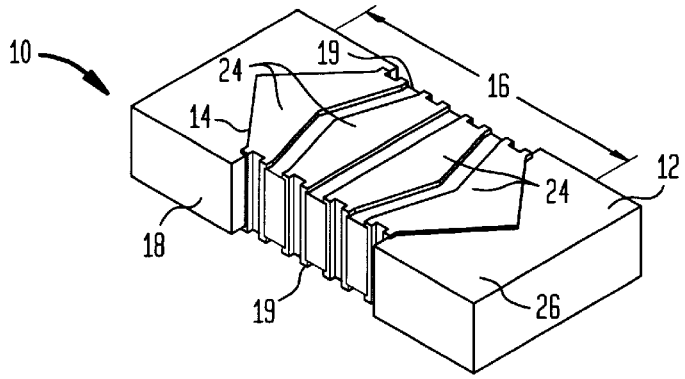
FIG. 1 is a perspective view of a low-profile chip inductor according to the present invention.
Figure 2:
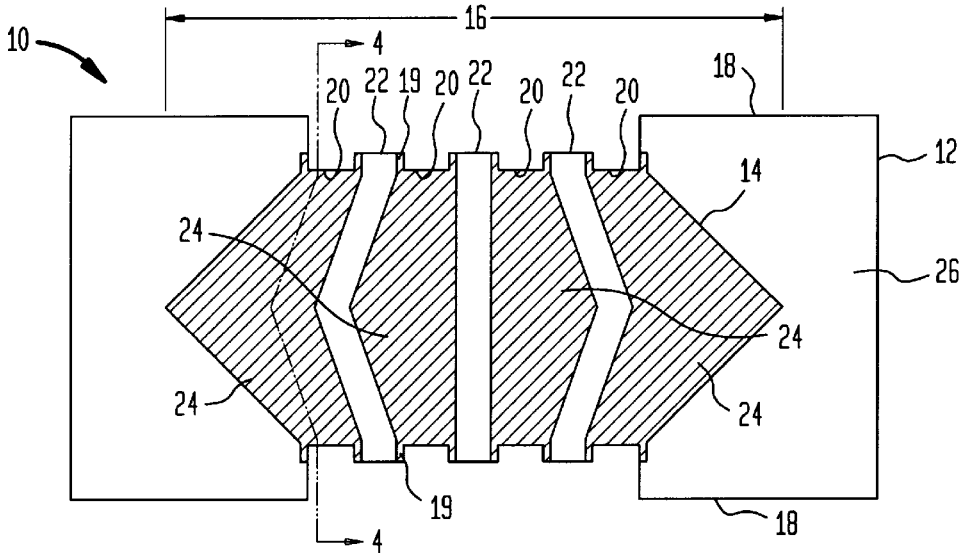
FIG. 2 is a top plan view of the chip inductor of FIG. 1.
Figure 3:
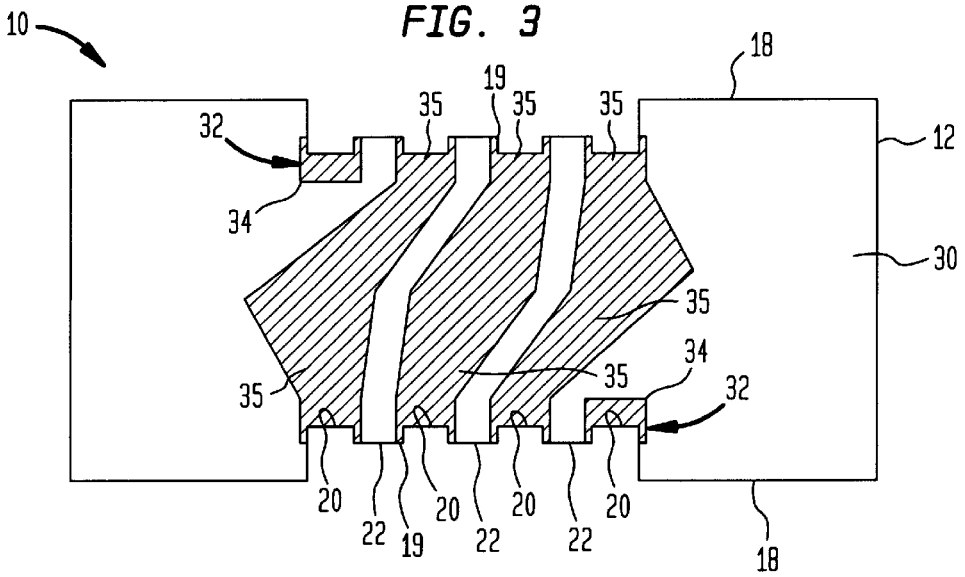
FIG. 3 is a bottom plan view of the chip inductor of FIG. 1.

FIGS. 1–3 show an integral low profile surface mountable chip inductor 10. The chip inductor 10 comprises a body 12 of magnetic material that is metallized with a coating of conductive material that defines a continuous conductive winding or coil 14. The winding 14 surrounds a portion 16 of the body 12 referred to as a core element. The side surfaces 18 of the body 12 in the area of the core element 16 include recessed crenelated surface portions 19 defined by alternating secondary recess surfaces 20 and projecting surfaces 22.

The turns 24 of the winding 14 extend across the face surface 26, the mounting surface 30, and each side surface 18 of the body 12. The terminal ends 32 of the winding 14 are located on the mounting surface 30. Each terminal end 32 includes a rectangular contact pad 34 which permits the chip inductor 10 to electrically couple to various circuit elements associated with the board. The regions 35 where the windings approach the secondary recesses include rectangular contact pads which enable surface mounting and self-alignment with corresponding contact pads (not shown) on the board in a surface mount solder reflow operation. The winding 14 varies in width according to its location on the body 12. The portions of the winding 14 extending across the face and mounting surfaces 26, 30 have a maximum width that is larger than the width of the portions of the winding 14 extending across the side surfaces 18. In the shown embodiment, the portion of the winding 14 extending across the side surfaces 18 pass over the secondary recess surfaces 20 such that they are separated by the non-metallized (insulating) projecting surfaces 22. In other embodiments, the portion of the winding extending across the side surfaces 18 can pass over the projecting surfaces 22 so that they are separated by the secondary recess surfaces 20. FIGS. 1–3 show a case where the winding comprises 4 turns. More generally, the device comprises one or more windings each including one or more turns.

Figure 4:
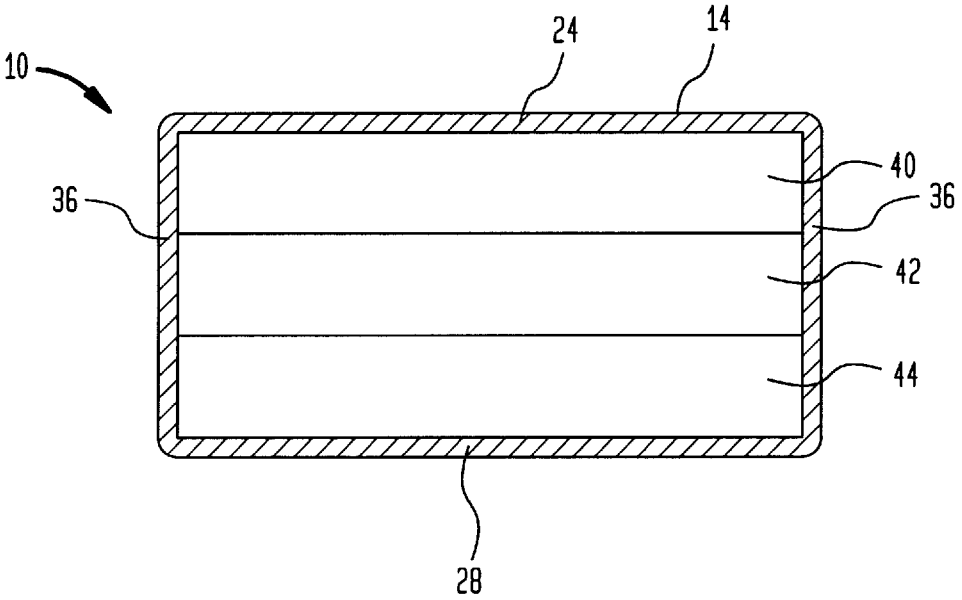
FIG. 4 is a cross sectional view through line 4—4 FIG. 2.

FIG. 4 is a cross-sectional view through line 4—4 of FIG. 2. The body 12 of the chip inductor 10 can consist of multiple layers of magnetic material including an uppermost layer 40, an intermediate layer 42, and a lowermost layer 44. The body of the chip inductor may also include more than one intermediate layer and can also be constructed from a single layer of magnetic material if desired.

Figure 5A:
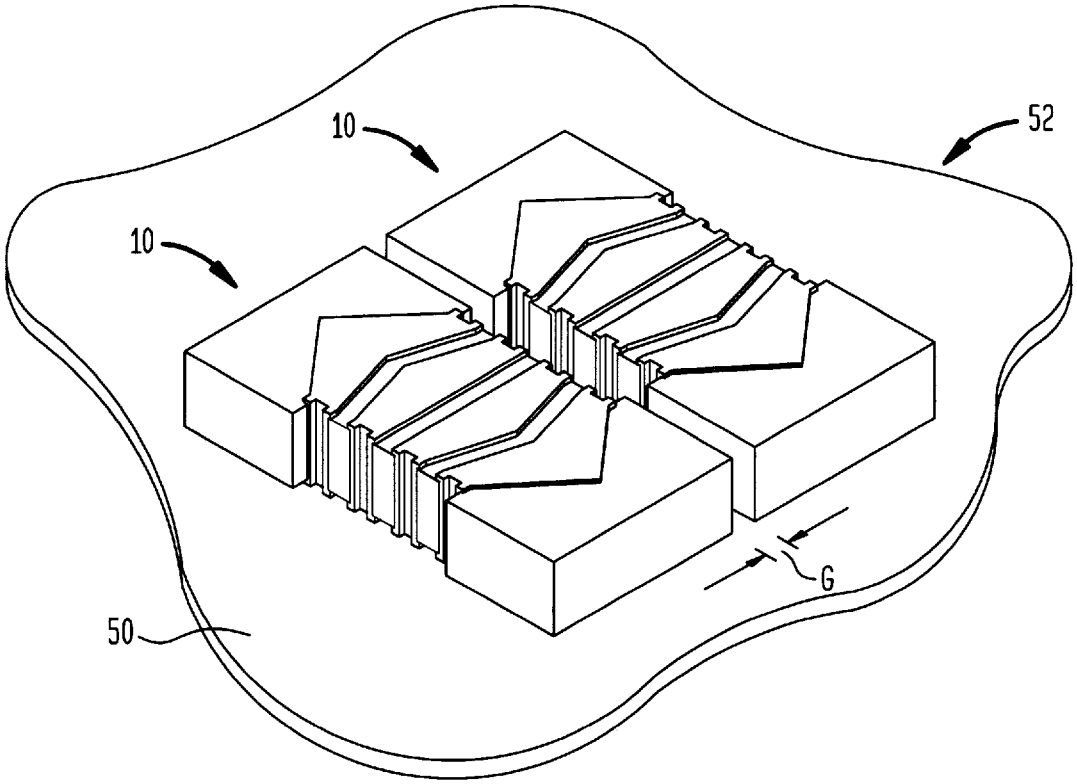
FIG. 5A is a perspective view of a low profile gapped U-core pair inductor or transformer assembled from two chip inductors.
Figure 5B:
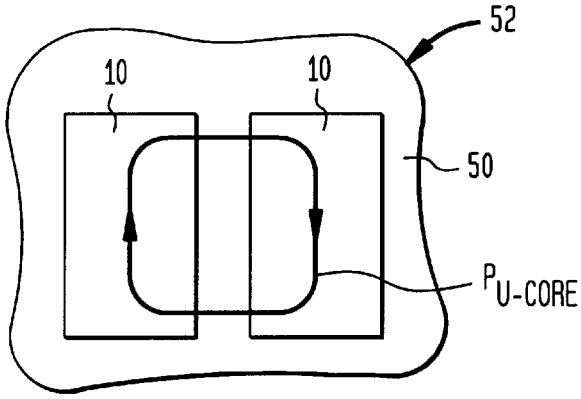
FIG. 5B is a schematic top plan view of the inductor or transformer of FIG. 5A.

One or more chip inductors can be surface-mounted to a printed circuit (PC) board to assemble a variety of advantageous magnetic devices. FIG. 5A shows two of the chip inductors 10 surface-mounted side by side on a PC board 50 separated by a gap G and connected in series in a magnetic circuit producing a low profile gapped U-core pair inductor or transformer 52. FIG. 5B shows the magnetic flux path $P_{U\text{-}core}$ of this gapped U-core inductor or transformer pair. The magnetic flux path $P_{U\text{-}core}$ is confined within the bodies of the chips 10.

Figure 6:
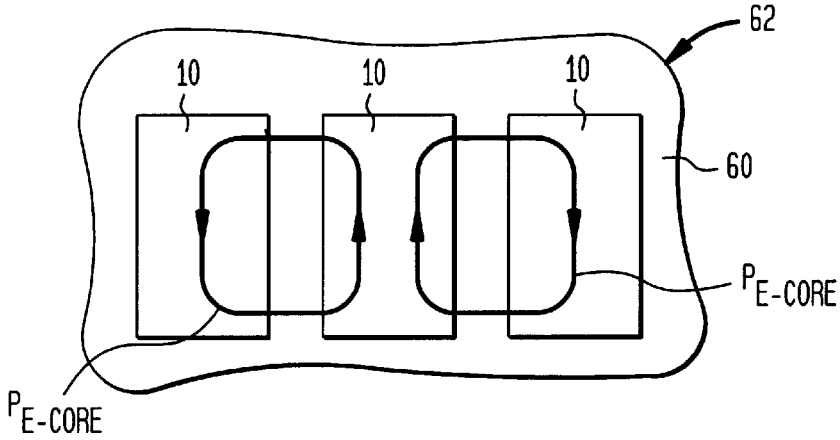
FIG. 6 is a schematic top plan view of a low profile E-core inductor or transformer assembled from three chip inductors.

FIG. 6 shows three of the chip inductors 10 surface-mounted side by side on a PC board 60 in a magnetic circuit to form a low profile E-core inductor or transformer 62. This device produces two magnetic flux paths $P_{E\text{-}core}$ which are confined within the bodies of the chips 10.

Figure 7:
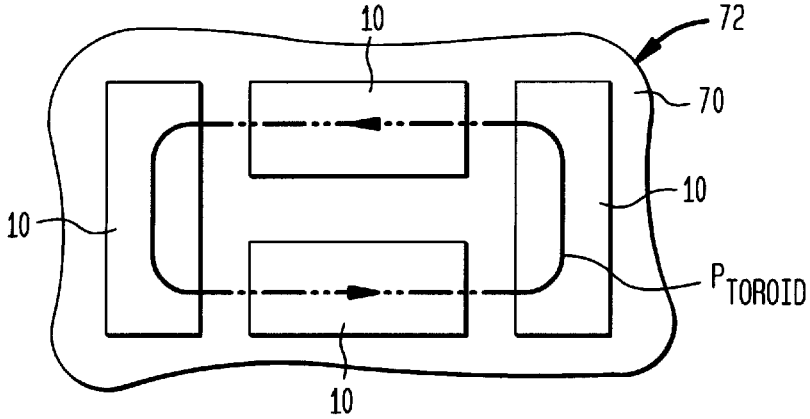
FIG. 7 is a schematic top plan view of a gapped toroid assembled from four chip inductors.

FIG. 7 shows four of the chip inductors 10 mounted on a PC board 70 in a rectangular arrangement which produces a magnetic circuit 72 equivalent to a gapped toroid. The device 72 produces a magnetic flux path $P_{torid}$ which is confined within the bodies of the chips 10.

In addition to confining the magnetic flux within components bodies, magnetically coupled chip inductors can provide higher levels of inductance than a corresponding number of uncoupled chip inductors.

FIGS. 8A–8J depict a multilayer green tape and thick film process for forming the chip inductors having bodies fabricated from at least one layer of magnetic material. The following process will be described as it relates to the fabrication of chip inductors having three layers of magnetic material.

Figure 8A:
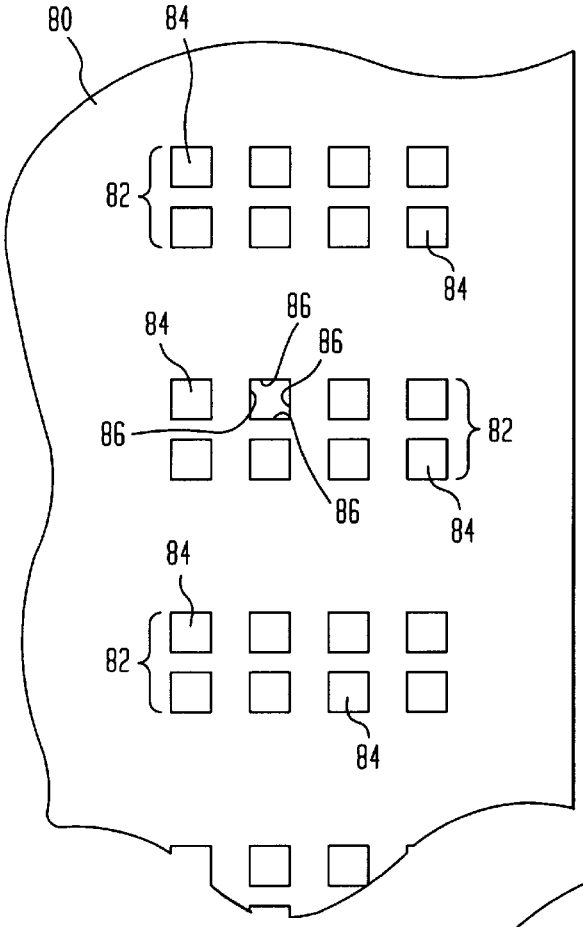
FIGS. 8A–8I depict a process for making the chip inductor of the present invention.

FIG. 8A shows one of three tape sections 80 of magnetic material used in fabricating the chip inductors. The tape section 80 of magnetic material is shown after paired rows 82 of vias 84 have been defined therein. The magnetic material used for making the tape sections 80 is selected from magnetic materials which can be metallized including but not limited to magnetic ceramics. The tape section 80 of magnetic material shown in FIG. 8A is composed of a green (unfired) magnetic ceramic material. The magnetic ceramic material may include a spinnel ferrite of the form $M_{1+x}Fe_{2-y}O_{4-z}$ where the values for x, y, and z may assume both positive and negative numerical values. The M material typically includes at least one of the elements Mn, Ni, Zn, Fe, Cu, Co, Zr, Va, Cd, Ti, Cr, and Si. Exemplary ferrites are those ferrites which have high resistivities such as nickel-zinc ferrites and certain manganese-zinc ferrites.

The ceramic raw materials (can be a single ceramic raw material) are provided in a powdered form. The ceramic powders are typically mixed with a suitable organic binder and cast in the form of a tape. The green ceramic tape is cut into a plurality of tape sections 80. At this stage of the process, forming and metallization processes can be performed on each individual tape section 80 or on a stacked group of tape sections which have been laminated together under low pressure in the range of 500 to 3,000 PSI at a temperature on the order of 50° C. to 100° C. The formation of multilayered ceramic bodies from green ceramic tapes is described in U.S. Pat. No. 5,239,744 to Fleming et al., the disclosure of which is incorporated herein by reference.

The vias 84 defined in the ceramic tape section 80 extend from the top and bottom surfaces thereof and can possess the illustrated square geometry that produces four surfaces 86. Vias having circular geometries may also be used. The vias 84 can be created by punching the ceramic tape section 80 in a suitable punch press which uses a male punch corresponding to the size and shape of the via to be formed. Any technique capable of forming vias in a green ceramic tape can be used.

Figure 8B:
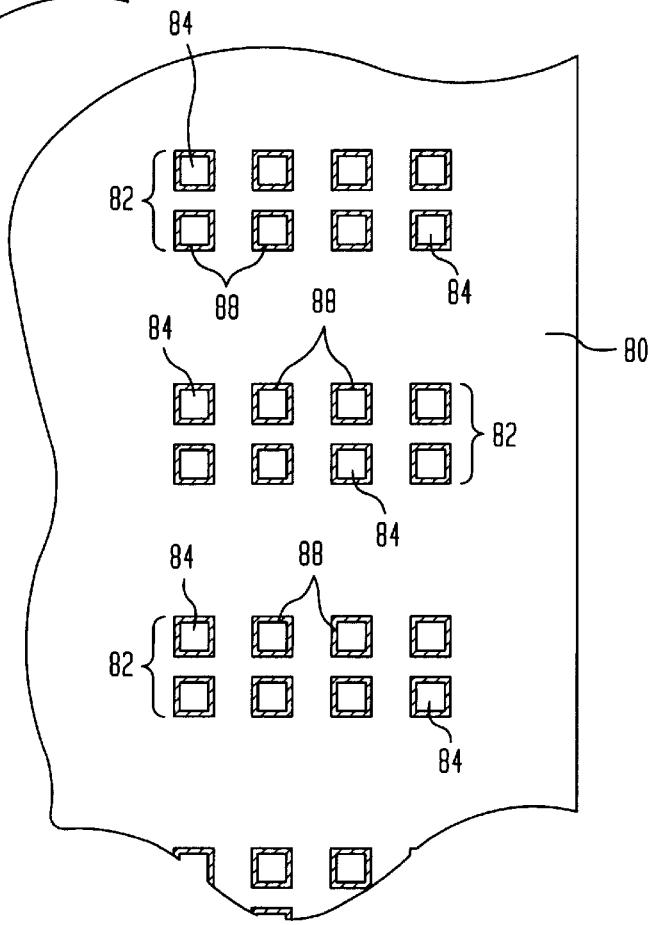

FIG. 8B shows a layer of conductive ink 88 applied to the four surfaces 86 (FIG. 8A) of each of the vias 84 in the tape section 80. The conductive ink used may be a silver, a palladium, or a silver-palladium conductive ink. Such conductive inks are commercially available from many suppliers such as Ceronics Inc., Matawan, N.J. Conductive inks typically comprise a metallic particulate suspension in an organic binder, which can be applied using screenprinting techniques. The conductive ink is typically printed through a metal mask using vacuum suction to coat the surface or surfaces of each via 84.

Figure 8C:
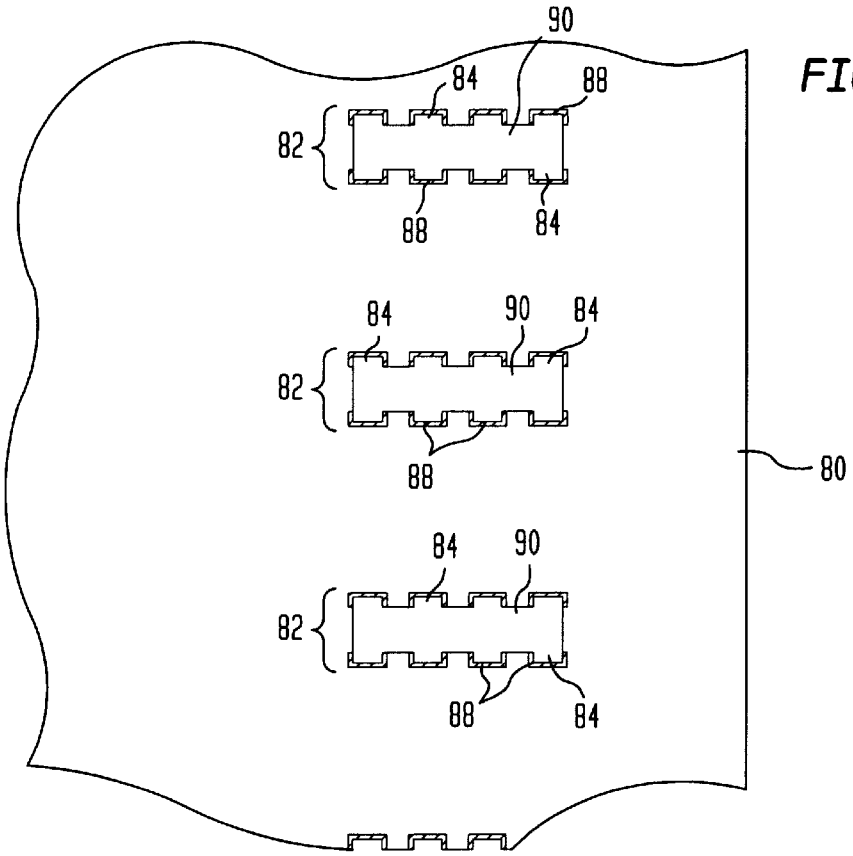

FIG. 8C shows each pairing of via rows 82 connected together by an elongated aperture 90 created in the tape section 80. The creation of the apertures 90 removes portions of the vias 84 in each row pair 82 thus, creating the crenelated recessed surfaces of the chip inductors. The conductive ink 88 applied to the remaining portions of the vias 84 will form the portions of the windings extending across the crenelated recessed surfaces of the chip inductors. When the apertures 90 are formed in the individual green tape sections 80, registration holes (not shown) are typically formed in non-device areas of the tape sections 80. Registration rods (not shown) can then be inserted in the registration holes to assure alignment of the apertures 90 from each of the tape sections 80 when the tape sections 80 are later stacked.

The process steps depicted in FIGS. 8A–8C are performed on each of the three tape sections. Two of the three tape sections 80 are then selected for further processing.

Figure 8D:
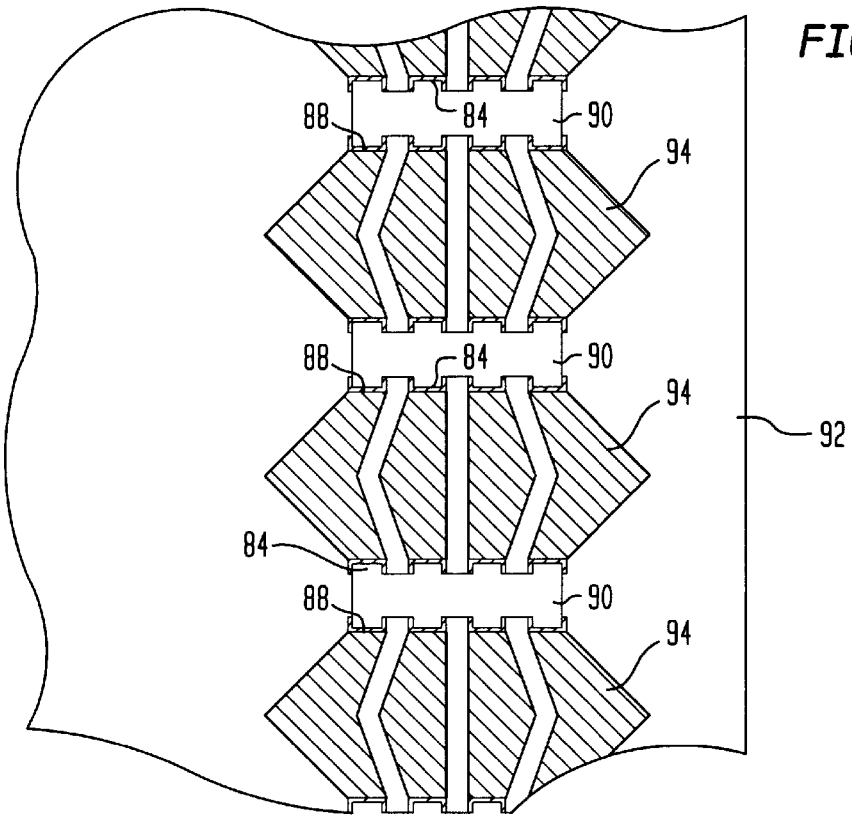
Figure 8E:
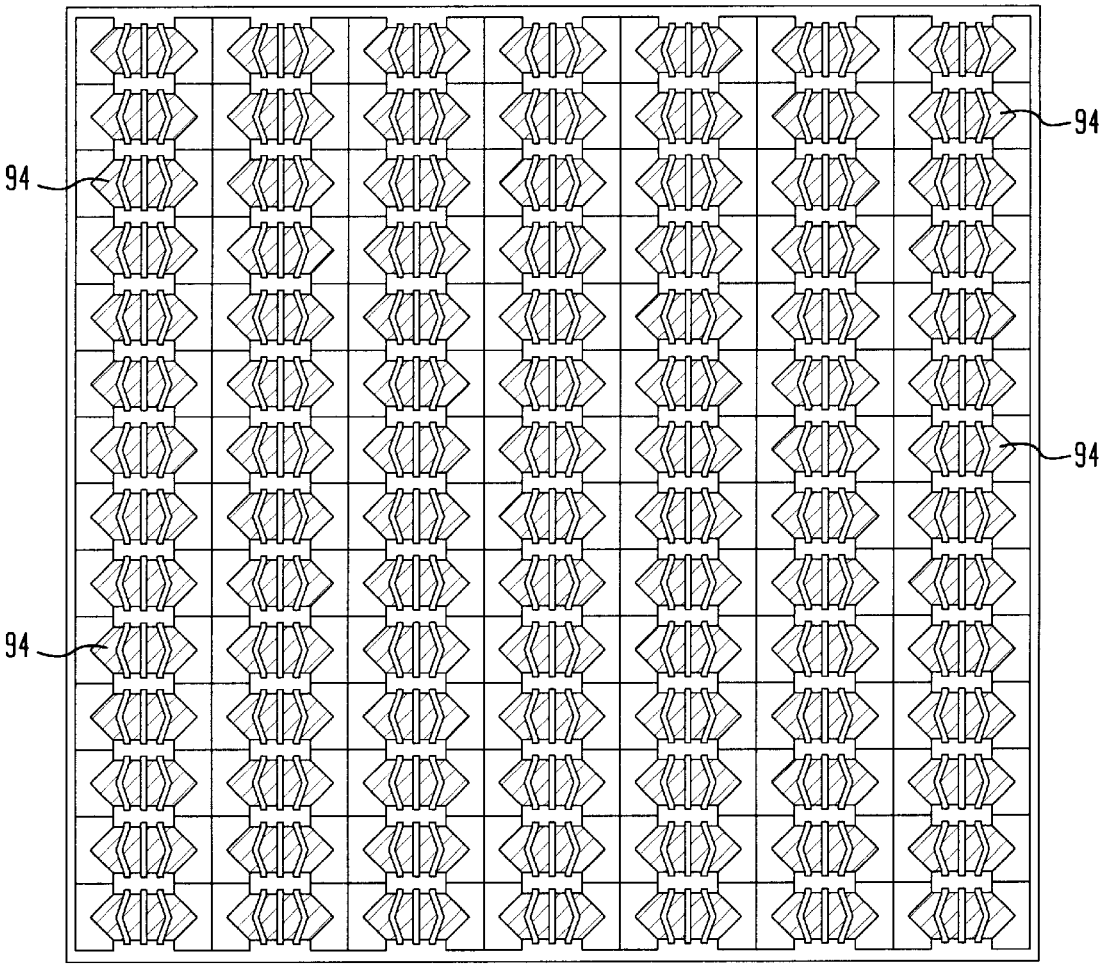

FIG. 8D shows a pattern 94 of conductive ink screen printed onto one of the two selected green tape sections using a conductive ink similar to that applied to the vias 84. The pattern 94 shown in the figure defines the portions of the windings which span across the face surfaces of the chip inductors. FIG. 8E is a plan view of the entire tape section 94 after screen printing.

Figure 8F:
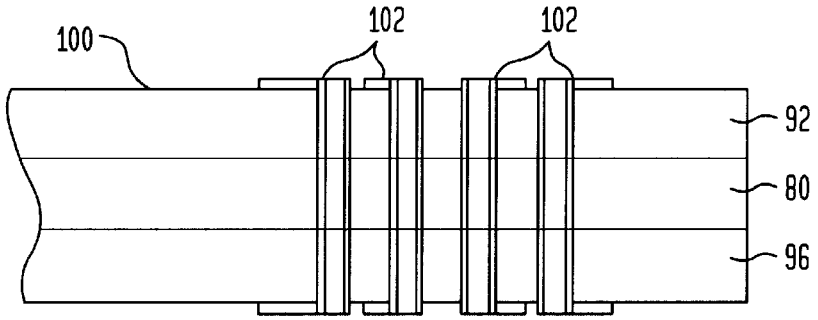

A second pattern of conductive ink is printed onto the remaining one of the two selected tape sections (96 of FIG. 8F). This pattern defines the portions of the windings which span across the mounting surfaces of the chip inductors (includes the winding contact pads).

Because the transverse lines are only on the face and mounting surfaces of the chip inductors, the steps depicted in FIGS. 8D–8E are performed on only one side of the two selected tape sections. Tape sections used in single layer chip inductors are screen printed on both sides with respective portions of the winding pattern.

The three tape sections 80, 92, 96 are stacked and laminated together into a mutilayered green laminate 100 as shown in FIG. 8F. (This step is omitted when making single layer chip inductors.) The tape sections 92, 96 with the face and mounted surface winding patterns are oriented in the stack so that they form the uppermost and lowermost tape sections of the laminate 100.

Figure 8G:
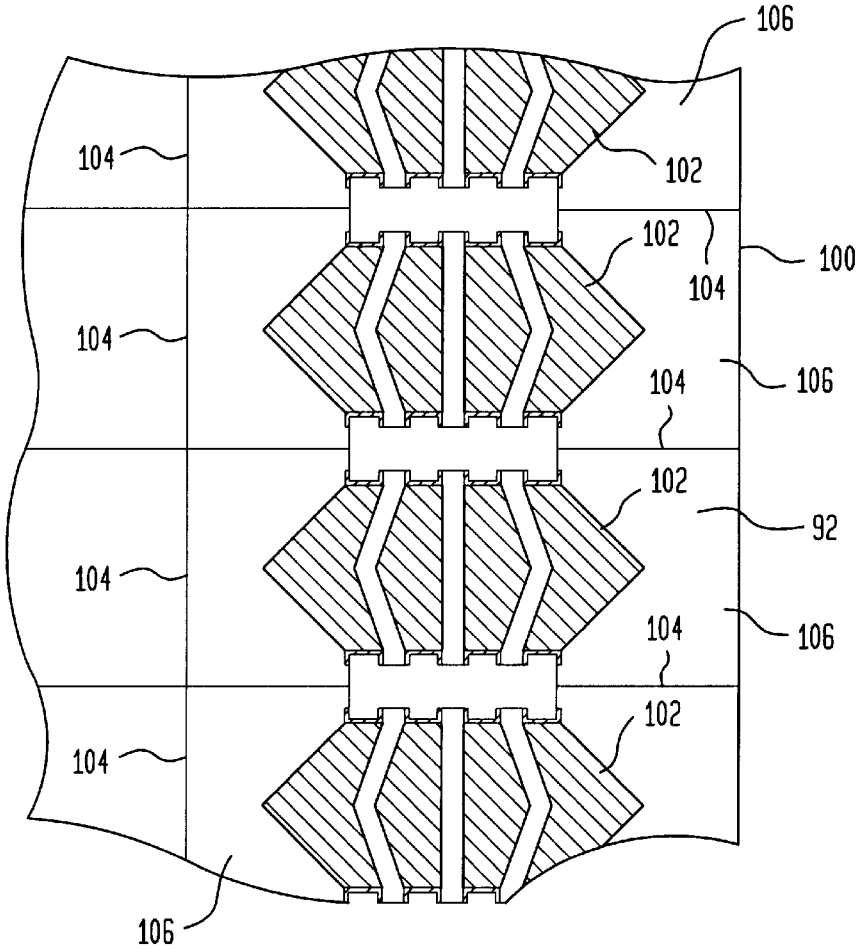

FIG. 8G shows dicing lines 104 scribed into the green laminate 100 (only the uppermost tape section 92 of the laminate 100 is visible). The dicing lines 104 outline a plurality of discrete inductors 106 and facilitate their separation from each in later processing. The laminate 100 is sintered between 800° C. and 1400° C. This "co-fires" or densifies the ceramic tape sections 80, 92, 96 and the windings 102 of conductive ink. During sintering, the metallic particles in the conductive ink bond to the ceramic tape sections 80, 92, 96, to form a winding integral with the fired body.

Figure 8H:
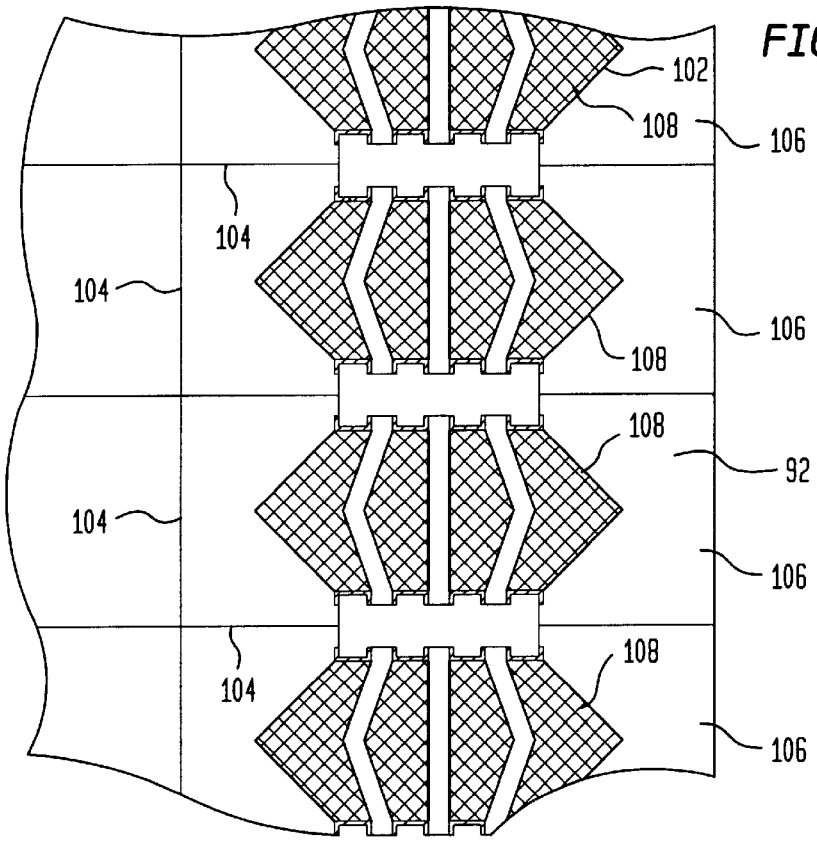

FIG. 8H shows the windings 102 of the co-fired laminate 100 after plating 108 with additional metals such as copper and nickel to increase the current carrying capacity of the windings 102. Copper plating may be performed by any plating technique with electrolytic plating being exemplary. This is accomplished by electrolytically depositing a layer of copper onto the windings of the laminate followed by the electrolytic or electroless deposition of nickel.

Figure 8I:
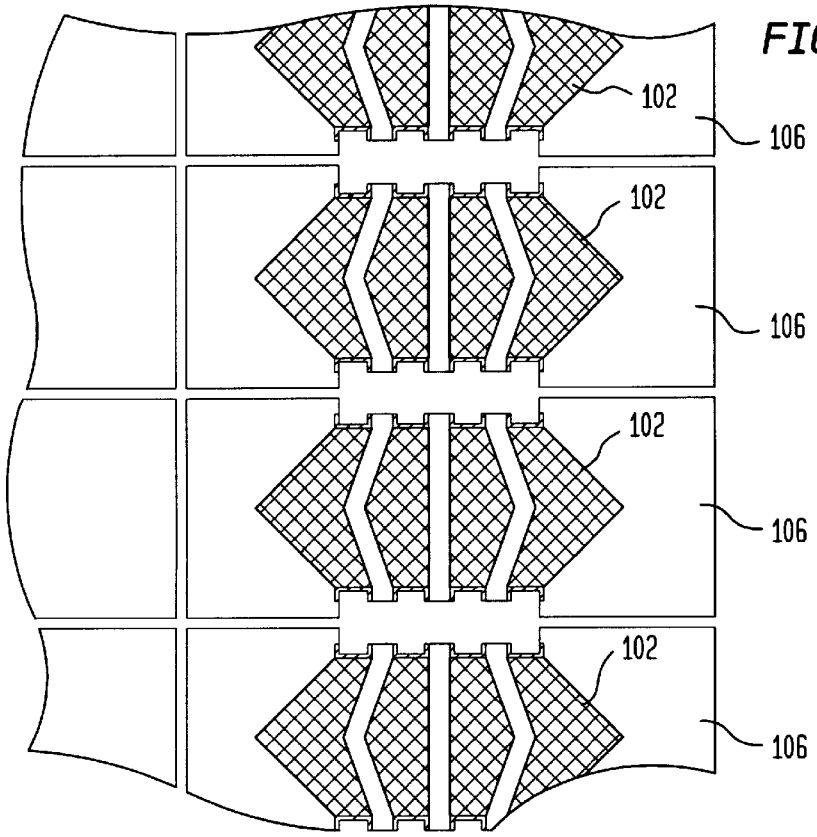

FIG. 8I shows the multilayered laminate 100 being divided along the dice lines 104 to yield the plurality of discrete chip inductors 106.

FIGS. 9A–9D depict an alternative process for making a chip inductor of the present invention. The alternative process is substantially similar to the process depicted in FIGS. 8A–8I, therefore, FIGS. 9A–9D illustrate only the differences.

Figure 9A:
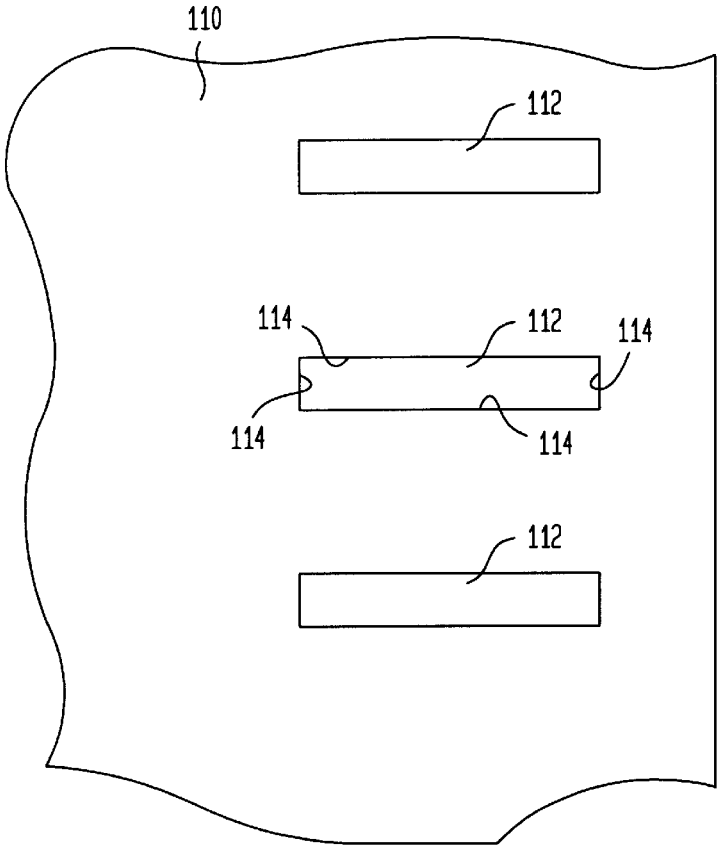
FIGS. 9A–9D depict an alternative process for making the chip inductor of the present invention.

In the alternative process, a single elongated via 112 is created in the green tape section 110 as shown in FIG. 9A.

Figure 9B:
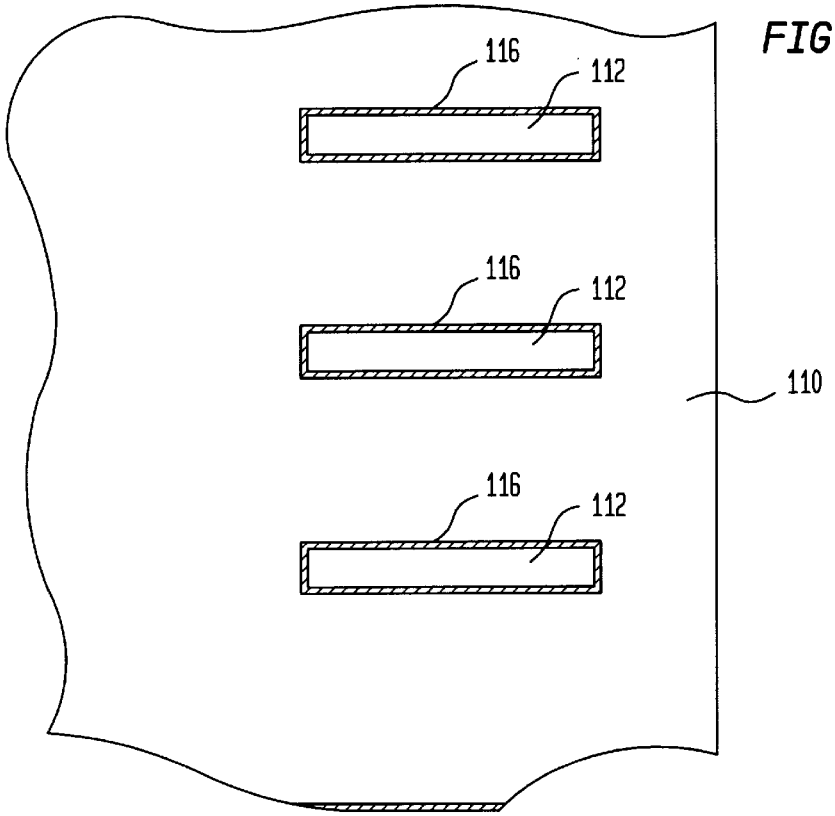

FIG. 9B shows a layer 116 of conductive ink applied to the four surfaces 114 of each of the elongated vias 112 in the tape section 110.

Figure 9C:
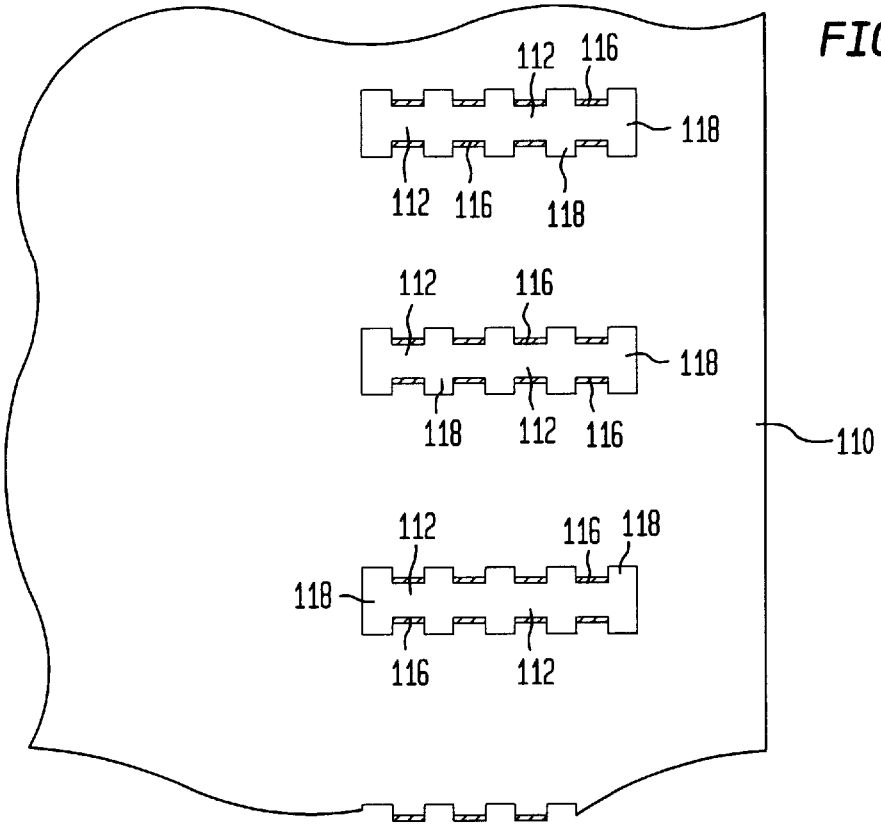

FIG. 9C shows a plurality of spaced apart transverse apertures 118 are created in the tape section 110. The apertures 110 remove portions of each via 112 and defines the crenelated side surfaces of the body of the chip inductors. The conductive ink 116 in the remaining portions of each via 112 will form the portions of the windings extending across the crenelated recessed surfaces of the inductors.

Figure 9D:
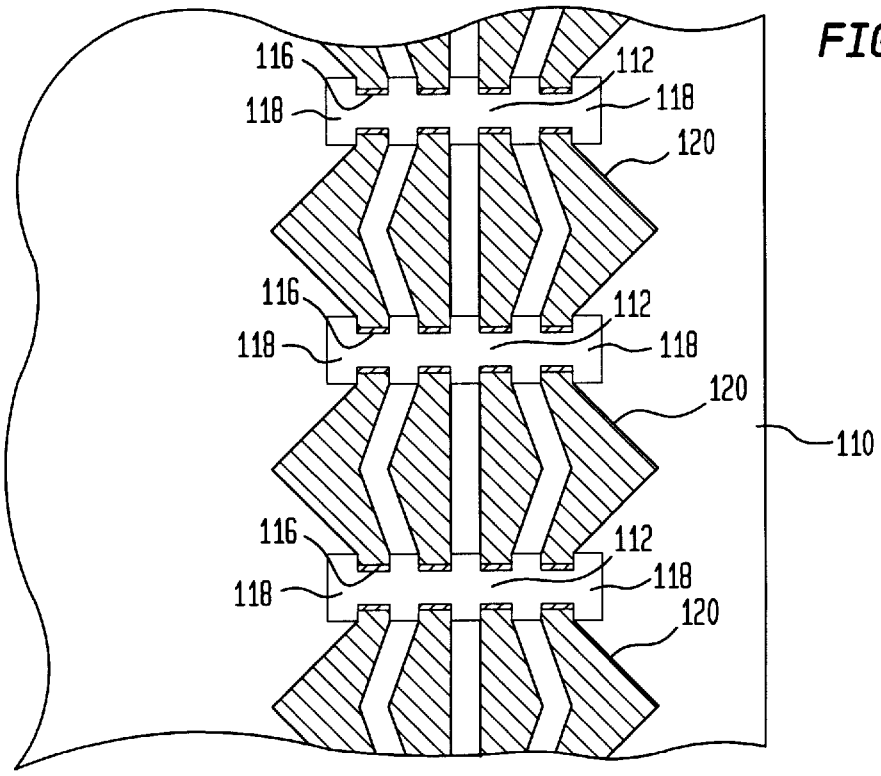

In FIG. 9D, patterns 120 of conductive ink are screen printed onto two selected green tape sections 110 (only one shown). The patterns define the portions of the windings which span across the face and mounting surfaces of the inductors. The green tape sections 110 are stacked, diced, sintered, and singulated as described above.

While the foregoing invention has been described with reference to the above embodiments, various modifications and changes may be made without departing from the spirit of the present invention. Accordingly, modifications and changes such as those suggested above but not limited thereto are considered to be within the scope of the claims.

What is claimed is:

1. An integral low profile inductive device comprising:

a magnetic body having opposing face surfaces and opposing side surfaces extending between the face surfaces;

recessed surfaces extending between the face surfaces defined in each of the side surfaces of said magnetic body, each of the recessed surfaces crenelated within by alternating secondary recesses in said magnetic body and projections of said magnetic body; and a continuous winding of conductive material integral with the body, the winding having portions extending across the recessed surfaces and face surfaces of the body, the portions of the winding passing across the recessed surfaces selectively passing over either secondary recesses or secondary projections to separate successive coils of the winding.

2. The inductive device according to claim 1, wherein the winding varies in width according to its location on the body, the portions of the winding extending across the face surfaces having a maximum width that is larger than the width of the portions of the winding extending across the recessed surfaces.

3. The inductive device according to claim 1, wherein the portions of the winding extending across the recessed surfaces pass over the secondary recesses.

4. The inductive device according to claim 1, wherein the winding includes bonding pads at terminal ends of the winding, the bonding pads located on one of the face surfaces of the body.

5. The inductive device according to claim 1, wherein the magnetic body is made from a ceramic material.

6. The inductive device according to claim 1, wherein the magnetic body is made from a ferrite material.

7. The inductive device according to claim 1, wherein the winding includes a layer of conductive plated material.

8. The inductive device according to claim 1, wherein the portions of the winding extending across the recessed surfaces pass over the secondary projections.

* * * * *